US009290983B2

(12) United States Patent
Bane et al.

(10) Patent No.: US 9,290,983 B2
(45) Date of Patent: Mar. 22, 2016

(54) TAMPER EVIDENT STORAGE DEVICE FOR ITEMS OF VALUE

(71) Applicant: Crane Payment Innovations, Inc., Malvern, PA (US)

(72) Inventors: Steven Bane, Hilderstone Staffs (GB); Robin Varley, Berkshire (GB); David Blasko, Trappe, PA (US)

(73) Assignee: Crane Payment Innovations, Inc., Malvern, PA (US)

( * ) Notice: Subject to any disclaimer, the term of this patent is extended or adjusted under 35 U.S.C. 154(b) by 0 days.

(21) Appl. No.: 14/101,625

(22) Filed: Dec. 10, 2013

(65) Prior Publication Data

US 2014/0165887 A1 Jun. 19, 2014

Related U.S. Application Data

(60) Provisional application No. 61/737,970, filed on Dec. 17, 2012.

(51) Int. Cl.

| | |
|---|---|
| ***E05G 1/026*** | (2006.01) |
| ***G07D 11/00*** | (2006.01) |
| ***E05G 1/04*** | (2006.01) |
| *E05G 1/00* | (2006.01) |

(52) U.S. Cl.
CPC *E05G 1/026* (2013.01); *E05G 1/04* (2013.01); *G07D 11/0009* (2013.01); *E05G 1/005* (2013.01)

(58) Field of Classification Search
CPC ..... G07D 11/0006; G07D 11/0009; E05G 1/005; E05G 1/026; E05G 1/04; G07F 7/04; G07F 9/06; B65H 2701/1912; E05B 65/0075
USPC ..... 232/1 D, 15, 16, 44, 43.2; 194/350, 351, 194/206, 202; 109/47, 59 R, 64, 66; 70/63, 70/160
See application file for complete search history.

(56) References Cited

U.S. PATENT DOCUMENTS

| | | | | | |
|---|---|---|---|---|---|
| 4,186,977 | A | * | 2/1980 | Gilovich et al. | 312/215 |
| 4,275,667 | A | * | 6/1981 | Hilton | 109/44 |
| 4,452,390 | A | * | 6/1984 | West | 232/4 R |
| 4,529,119 | A | * | 7/1985 | Granzow et al. | 232/43.3 |
| 4,659,008 | A | * | 4/1987 | Howett et al. | 232/43.3 |
| 4,798,316 | A | * | 1/1989 | Martin et al. | 232/43.1 |
| 5,129,330 | A | * | 7/1992 | McKay et al. | 109/59 R |

(Continued)

FOREIGN PATENT DOCUMENTS

| | | | |
|---|---|---|---|
| WO | WO-9953452 | A1 | 10/1999 |
| WO | WO-2006072781 | A1 | 7/2006 |
| WO | WO-2009103933 | A1 | 8/2009 |

*Primary Examiner* — William Miller

(57) ABSTRACT

A system for storing items of value includes a lockable cassette, a door, a container, and a locking mechanism. The lockable cassette includes an opening for receiving items of value. The door is operably coupled to the cassette and is movable between an open position providing access to the contents of the cassette and a closed position preventing access to the contents of the cassette. The container is removably coupled to the cassette for securely storing items of value and includes a closure mechanism configured to restrict access to the stored items of value in the container. The locking mechanism is coupled to the door and is configured to selectively lock the door in the closed position and to selectively operate the closure mechanism. Related apparatus, systems, techniques, and articles are also described.

20 Claims, 15 Drawing Sheets

(56) References Cited

U.S. PATENT DOCUMENTS

| | | | | | |
|---|---|---|---|---|---|
| 5,405,131 | A * | 4/1995 | Zouzoulas | 271/181 |
| 5,533,605 | A * | 7/1996 | Mays et al. | 194/206 |
| 5,595,129 | A * | 1/1997 | Grobe | 109/22 |
| 5,653,436 | A | 8/1997 | Zouzoulas | |
| 5,890,439 | A * | 4/1999 | McGunn | 109/47 |
| 6,059,090 | A * | 5/2000 | Davis et al. | 194/350 |
| 6,279,823 | B1 * | 8/2001 | Chou | 232/15 |
| 6,712,352 | B2 * | 3/2004 | Bergeron et al. | 271/180 |
| 6,843,409 | B2 * | 1/2005 | Park | 232/1 D |
| 7,837,095 | B2 * | 11/2010 | Clauser et al. | 235/379 |
| 8,104,764 | B2 * | 1/2012 | Saltsov et al. | 271/145 |
| 8,146,914 | B2 * | 4/2012 | Cost | 271/217 |
| 8,783,552 | B2 * | 7/2014 | Xu et al. | 232/1 D |

* cited by examiner

TAMPER EVIDENT STORAGE DEVICE FOR ITEMS OF VALUE

RELATED APPLICATIONS

This application claims priority to U.S. Provisional Patent Application No. 61/737,970 filed Dec. 17, 2012, the entire contents of which is hereby incorporated by reference herein.

FIELD OF DISCLOSURE

The disclosure relates to a system for storing items of value. In particular, the disclosure relates to a tamper evident system for storing items of value.

BACKGROUND

There are some known attempts to develop a secure container for transporting currency between one location and another. This is known in the arts as Cash in Transit (CIT). One problem of CIT when a currency validator is part of the system is that traditional currency cassettes are expensive and difficult to transport. Often there is a need to have a cheap inexpensive solution that can be employed within a currency accepting machine that provide a secure container for transporting the currency, but also tamper evident so that if any attempt to access the contents is made, there is a visual and obvious alteration of the container to notify authorities of such fraudulent attempts were made.

U.S. Pat. No. 7,837,095 to Clauser et. al. discloses a secure bag assembly for a lockable removable cassette which is expressly incorporated herein by reference in its entirety. In this disclosure there is a removable container capable of securing currency using a deployable strap to cover the opening of the container where currency is inserted. One disadvantage with such a solution is that it can be a highly complex device and the securing cover/strap must be actuated by a physical user/service person who is removing the container from the cassette.

U.S. Pat. No. 7,819,30 to Williams et. al. discloses a container for storing banknotes wherein the container is closed using a frangible locking key mechanism. In the solution disclosed, a security "key" is required to be inserted into the closure mechanism of the device in order to securely close the container before removal from the cassette or machine. One disadvantage with such a solution is that the securing key must be transported with the service personnel and manually inserted into the container to secure the contents. Such a solution required additional components and complexities.

U.S. Pat. No. 7,748,610 to Bell et. al discloses a bill validator system including a banknote container capable of being heat sealed to prevent access to the contents. The solution disclosed provides for a container having a container opening and closure system that requires a heat/sealing mechanism to activate adhesive substances integral to the container in order to permanently secure the contents and prevent them from being removed. One disadvantage of such a solution is that the host device of the container requires a complicated heating and sealing mechanism in order to cause a chemical reaction to take place to seal the bag or container.

International Patent Application Publication WO2012/040360A1 to Rao et. al discloses a banknote storage container system capable of causing the top of a flexible container to be heat sealed to prevent access to the contents. In the solution disclosed the system must integrate a complicated and expensive sealing mechanism to pinch the container material and cause chemical reactions to occur to seal the bag in a way to prevent access to the contents. One disadvantage of the system is that sealing mechanisms create an expensive device and take up precious space within money handling systems in order to accommodate the sealing mechanism.

The present solution of the disclosure aims to provide a secure container for overcoming the disadvantages of the existing solutions such as those mentioned previously.

SUMMARY

The subject matter of the disclosure relates to a container for securely storing items of value in a manner capable of being tamper evident. Items of value can include, but are not limited to, banknote, bills, checks, valuable papers, currency, coins, tokens, certificates, coupons, tickets, or any other item. In some implementations, there is provided a container configured to be operably coupled to a cassette or apparatus for handling items of currency. The container can include a closure mechanism fixedly coupled thereto for selectively transitioning from a state capable of allowing items of value to be inserted into the container and a closed or secure state preventing items of value form being inserted or removed from the container.

In some implementations, there is a system for storing items of value including a cassette configured for removable coupling of a secure container. In such implementations, the removable container can be configured to interface with a locking mechanism of the cassette or host handling machine. The locking mechanism is configured to transition the container closure mechanism from an open state to a closed state when access and/or removal of the container is require. The locking mechanism can include engagement features configured to engage complementary receptacles on the closure mechanism in order to enable actuation.

In some implementations, the cassette or host handling machine includes an automatic reset mechanism operatively coupled to the locking mechanism to re-arm or reset the locking mechanism after it has actuated the closure mechanism. The reset mechanism can be configured to synchronize the resetting function of the automatic reset mechanism with the opening of a door or access panel of the cassette or host handling machine. The reset mechanism can be configured to be automatically operated as the access panel or door of a cassette causes a linkage system within the reset mechanism to transition the locking mechanism back to an armed state or position. The locking mechanism can be engagable with an unused and open container located in the cassette of host handling machine.

In some implementations, a service person retrieves a secure container from a host machine by approaching the machine, using a key or other access credential to actuate a lock from a locked position to an unlocked position, once the lock has unlocked, the locking mechanism is released from the armed state to the actuated state. As the locking mechanism transitions from the armed state to the actuated state, the closure mechanism is simultaneously transitioned from an open state to a closed state and thus securing the contents of the container prior to removal of the container from the host machine or cassette.

In some implementations, the locking mechanism includes an engagement plate selectively coupled to the closure mechanism for transitioning the closure mechanism from an open state or position to a closed state when a lock of the locking mechanism is operated from a locked state to an unlocked state. The locking mechanism can further include a lock tab operable to engage a blocking member to release the locking mechanism from an armed state thus actuating the locking mechanism and closure mechanism to secure the contents of the container.

In some implementations, the container is a disposable container so that it can be used as a one-time device and once the contents of the container have been properly removed by an authorized entity or individual, the container can be disposed of or thrown out.

In some implementations, the secure container is configured for removable coupling with a currency cassette. The cassette can be configured to have a pivotable door coupled to the cassette and the locking mechanism integrated into the door. In such configurations, the locking of the door to the cassette enables the locking mechanism to be actuated upon the next unlocking of the door. Therefore, such a solution allows the actuation of the closure mechanism and to be an integrated function of accessing the cassette contents or location of the secure container.

In yet other implementations, an apparatus for securing items of value can include a housing configured to accept items of value and having an open end; an aperture plate, fixedly coupled to the housing and having an opening for inserting items of value into the housing; and a closure mechanism operably coupled to the aperture plate. The closure mechanism can be configured to move between an open position whereby items of value can be inserted through the opening in the aperture plate and into the housing, and a closed position wherein items of value are prevented from being inserted through the opening in the aperture plate and into the housing.

One or more of the following aspects can be included. For example the housing can be a flexible material. The housing can be a rigid material. The flexible material can be a plastic material. The housing and the aperture plate can be integrally formed together to create a container for storing items of value. The housing and the aperture plate can be integrally formed together to create a currency container. The aperture plate and the housing can be made from a similar material. The aperture plate and the housing can be made from a common type of material. The material can be a plastic material. The plastic material can be at least one of polycarbonate, high impact polystyrene, Polyethylene, flexible plastic, or ABS plastic.

The closure mechanism can include a shutter operably coupled to the aperture plate and configured to move between the open position and the closed position. The shutter can further include locking features for locking engagement with the aperture plate when in the closed position. The locking features can be frangible. The shutter can be slidingly coupled to the aperture plate. The shutter can further include frangible features capable of guiding the shutter between the open position and the closed position. The shutter can further comprise at least one locking feature operable to secure the cover plate in the closed position. The at least one locking feature can be frangible. The at least one locking feature can be configured to be tamper evident when the shutter is moved from the closed position. The at least one locking feature can be a locking tab. The each of the at least one locking tabs can be configured to lockingly engage with the aperture plate by inserting the at least one locking tab into a locking receptacle located in the aperture plate. The closure mechanism can be configured to be operable by an actuation mechanism. The actuation mechanism can be configured to selectively engage the shutter and actuate the shutter between the open and closed positions.

The apparatus for securing items of value can be selectively coupled to a currency validator. The apparatus for securing items of value can be selectively coupled to a sheet stacking mechanism. The sheet stacking mechanism can be configured to insert items of value through the opening of the aperture plate when the closure mechanism is in the open position. The apparatus for storing items of value can be removable from the sheet stacking mechanism when the closure mechanism is in the closed position.

In yet another aspect, an apparatus for storing items of value can be selectively coupled to a cassette and can have a door moveable between an open position and a closed position. The door can be secured in the closed position by a locking mechanism, and a sheet stacking mechanism. The apparatus can include a housing configured to accept items of value and having an open end; an aperture plate, fixedly coupled to the housing and having an opening for inserting items of value into the housing; and a closure mechanism operably coupled to the aperture plate. The closure mechanism can be configured to move between an open position whereby items of value can be inserted through the opening in the aperture plate and into the housing, and a closed position wherein items of value are prevented from being inserted through the opening in the aperture plate and into the housing.

One or more of the following features can be included. For example, the closure mechanism can further include a shutter operably coupled to the aperture plate and configured to move between the open position and the closed position. The shutter can further include locking features for locking engagement with the aperture plate when in the closed position. The locking features can be frangible. The shutter can be slidingly coupled to the aperture plate. The shutter can further include frangible features capable of guiding the shutter between the open position and the closed position. The shutter can include at least one locking feature operable to secure the shutter in the closed position. The at least one locking feature can be frangible. The at least one locking feature can be configured to be tamper evident when the shutter is moved from the closed position. The at least one locking feature can be a locking tab. The each of the at least one locking tabs can be configured to lockingly engage with the aperture plate by inserting the at least one locking tab into a locking receptacle located in the aperture plate. The closure mechanism can be configured to be operable by an actuation mechanism. The actuation mechanism can be configured to selectively engage the shutter and actuate the shutter between the open and closed positions. The sheet stacking mechanism can be configured to insert items of value through the opening of the aperture plate when the closure mechanism is in the open position.

The apparatus for storing items of value can be removable from the sheet stacking mechanism when the closure mechanism is in the closed position. The locking mechanism can be selectively coupled to the closure mechanism when the door is in the closed position. The shutter can further include at least one driving receptacle. The actuation mechanism can further include at least one driving feature selectively coupling with the at least one driving receptacle on the shutter. The at least one driving feature of the actuation mechanism can be coupled to the at least one driving receptacle of the shutter when the door is in the closed position. The locking mechanism can selectively actuate the actuation mechanism to move the shutter between the open position and the closed position.

In yet another aspect, a system for storing items of value can include a lockable cassette, including an opening for receiving items of value; a door operably coupled to the cassette, wherein the door is movable between an open position providing access to the contents of the cassette and a closed position preventing access to the contents of the cassette; a container removably coupled to the cassette for securely storing items of value; a locking mechanism coupled to the door and configured to selectively lock the door in the closed position. The container can include a closure mechanism configured to restrict access to the stored items of value in the container. The locking mechanism can be further configured to selectively operate the closure mechanism.

One or more of the following features can be included. For example, the container can further include a housing coupled to the closure mechanism. The locking mechanism can be configured to selectively actuate the closure mechanism. The closure mechanism can further include an aperture plate and shutter movably coupled to the aperture plate. The shutter can be selectively movable between an open position allowing items of value to be inserted into the container and a closed position preventing items of value from being inserted or removed from the container. The locking mechanism can be in engagement with the closure mechanism when the door is in the closed position. The locking mechanism can be configured to transition the closure mechanism from an open position to a closed position when the locking mechanism is transitioned from an armed state to an actuated state. The aperture plate can include an opening configured to allow items of currency to be inserted into the container. The shutter can further include a locking feature, the locking feature configured to lockingly engage the aperture plate when the shutter is in a closed position. The shutter can be in a closed position when the shutter covers the opening in the aperture plate. The locking feature of the shutter plate can be frangible.

The locking feature can include at least one locking tab. The locking feature can include a plurality of locking tabs. The locking mechanism can further include a lock, the lock configured to selectively lock the door to the cassette. The lock can be configured to actuate the locking mechanism. The locking mechanism can further include a shutter engagement plate, the shutter engagement plate capable of engagement with the shutter when the door is in the closed position. The shutter can include at least one locking mechanism engagement receptacle, the at least one locking mechanism engagement receptacle configured to receive at least one actuation feature of the shutter engagement plate. The locking mechanism can further include a shutter plate biasing mechanism. The locking mechanism can further include shutter plate blocking component. The shutter plate blocking component can be selectively displaced by the lock. The lock can be actuated by a key. The locking mechanism can include an automatic reset mechanism. The automatic reset mechanism can be configured to reset the locking mechanism to an arming position as the door is transitioned from an open position to a closed position. The door can be pivotably coupled to the cassette. The door can be hingingly coupled to the cassette. The automatic reset mechanism can further include a linkage system configured to actuate the shutter locking plate from an activated position to an armed position as the door is transitioned from the open position to the closed position.

The linkage system can include a pivot arm; a pushrod; and a pivot lever. The pivot lever can be configured to exert longitudinal force on the pushrod and cause the pushrod to be longitudinally displaced relative to the door when the door is transitioned between the closed position and the open position. Longitudinal displacement of the pushrod causes rotational movement of the pivot arm. Rotation of the pivot arm during transition of the door from the closed position to the open position can cause the pivot arm to displace the locking mechanism from an actuated state to an armed state.

In yet another aspect, a method of retrieving a secure container, configured to store items of value, and coupled to an apparatus for handling items of value, can include actuating a locking mechanism from an armed state to an actuated state; transitioning an access panel from a closed position to an open position; and removing the secure container from the handling apparatus. The locking mechanism can actuate a closure mechanism of the secure container from an open position to a closed position. Movement of the access panel from the closed position to the open position can cause the locking mechanism to reset to an armed state.

One or more of the following features can be included. For example, inserting an open secure container into the handling apparatus; transitioning the access panel from the open position to the closed position; and locking the access panel in the closed position using the locking mechanism can be included.

An advantage of the subject matter disclosed, over comes disadvantages of known solutions by implementing a system capable of minimizing the need for operation by a service person or individual requiring access to the container when it needs to be removed. Additionally, the device disclosed eliminates the need of secondary components (e.g., container keys, covers or other parts not coupled to the device) to securely close the container prior to its removal. In the solution disclosed herein, the container is automatically closed in a secure state using the locking mechanism when access to the area housing the container is located. In such a scenario a service person need only have keys to the machine or cassette housing the container in order to actuate the closure mechanism and thus secure the contents of the container.

The details of one or more variations of the subject matter described herein are set forth in the accompanying drawings, claims, and the description below. Other features and advantages of the subject matter described herein will be apparent from the description and drawings, and from the claims.

DETAILED DESCRIPTION OF THE DISCLOSURE

Figure 1:
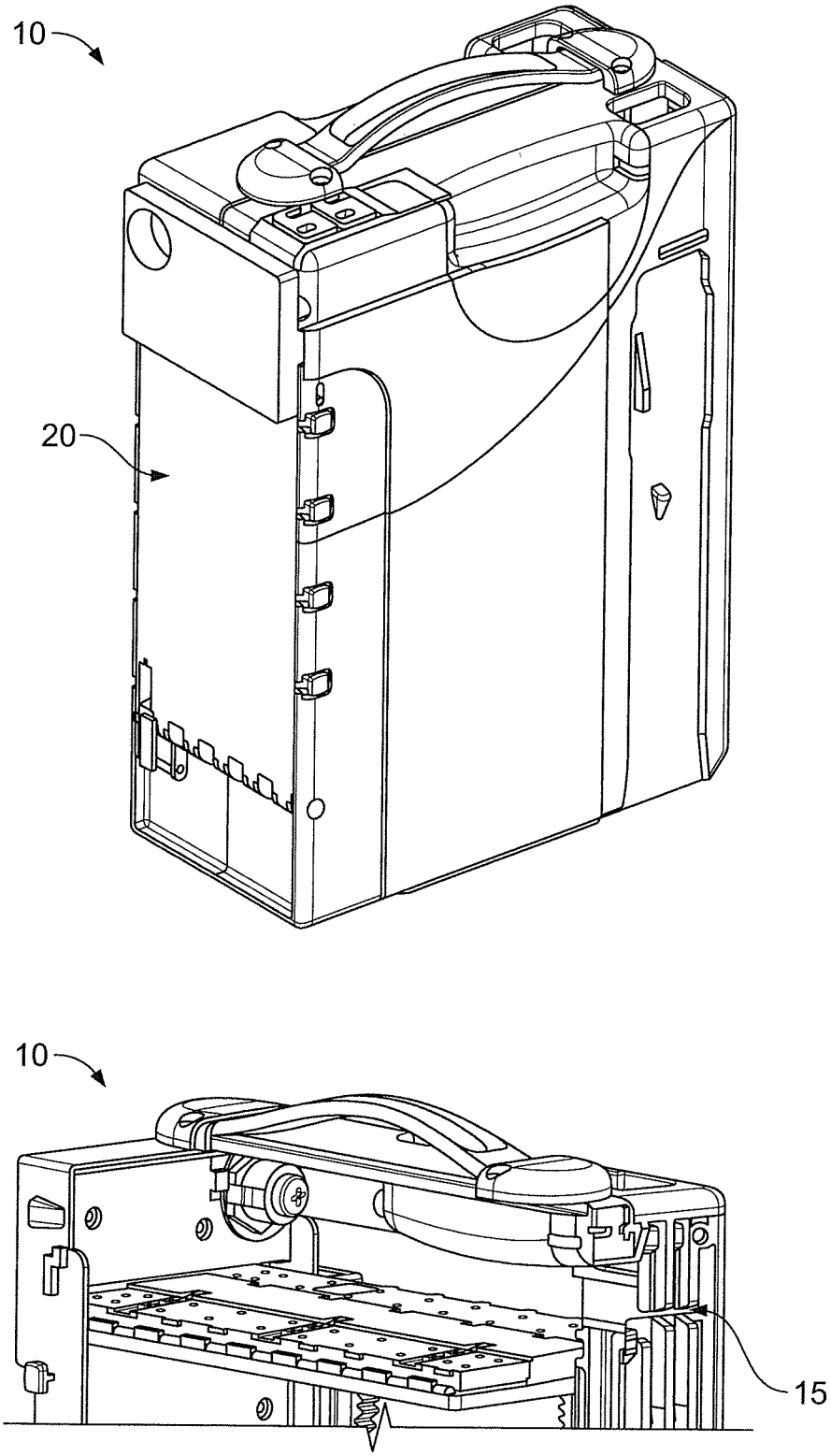
FIG. 1 illustrates an apparatus for storing items of value.

The disclosure relates to a system for storing items of value. In an example embodiment, as illustrated in FIG. 1, a lockable cassette 10 includes a selectively movable door 20 pivotably coupled to cassette 10. In other implementations, door 20 can be configured to be coupled to cassette 10 using other techniques including, but not limited to, sliding, clipping or connecting. Cassette 10 can further include an opening 15 configured to allow items of value to be inserted into cassette 10. An item of value can be, but not limited to, a banknote, bill, coin token, security paper, valuable sheet, coupon, currency, or other similar item. Door 20 is configured to be selectively transitioned from a closed position, as shown in FIG. 1, to an open position as shown in FIG. 2.

Figure 2:
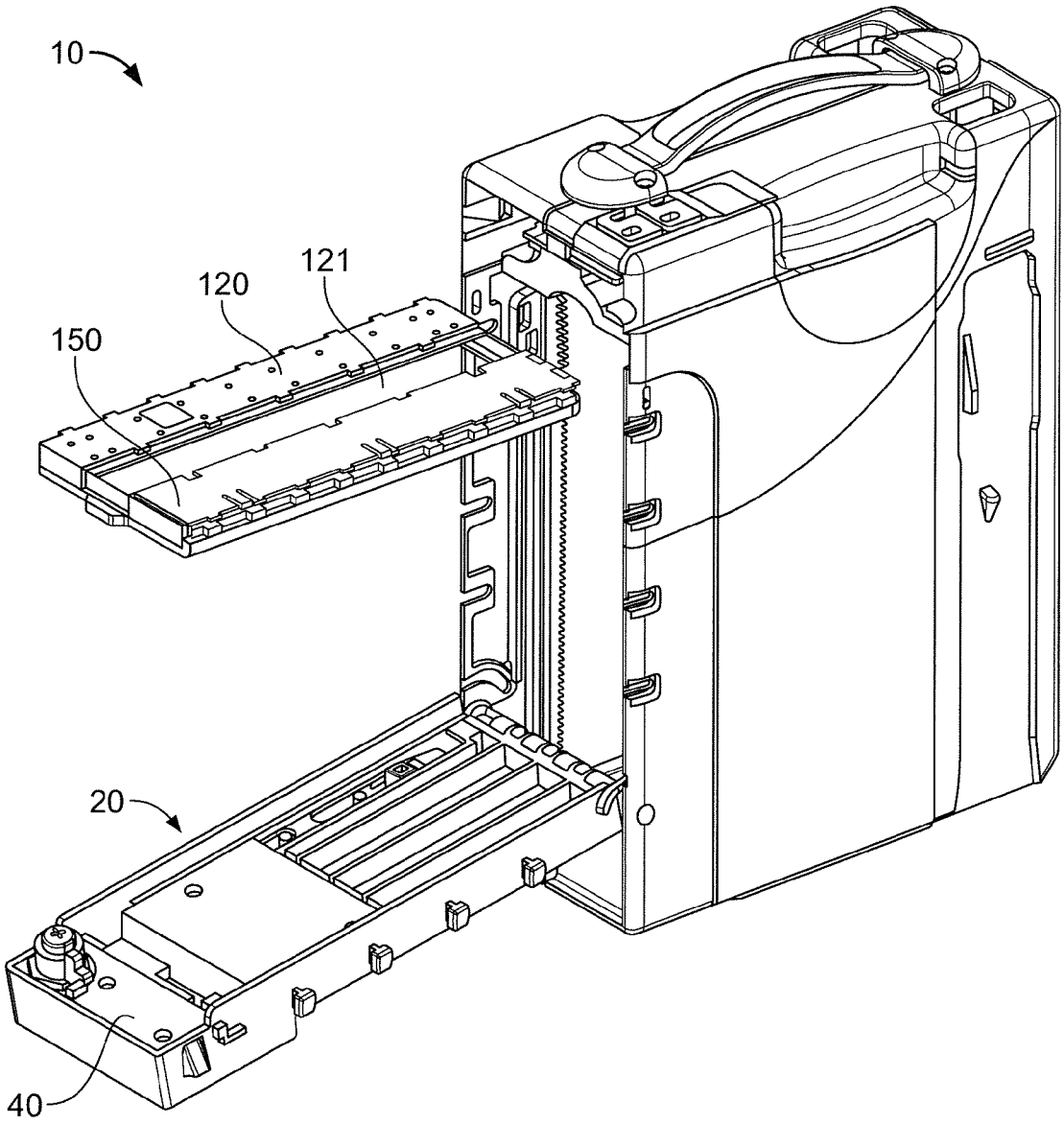
FIG. 2 illustrates an apparatus for storing items of value including an example container removably coupled thereto.
Figure 3:
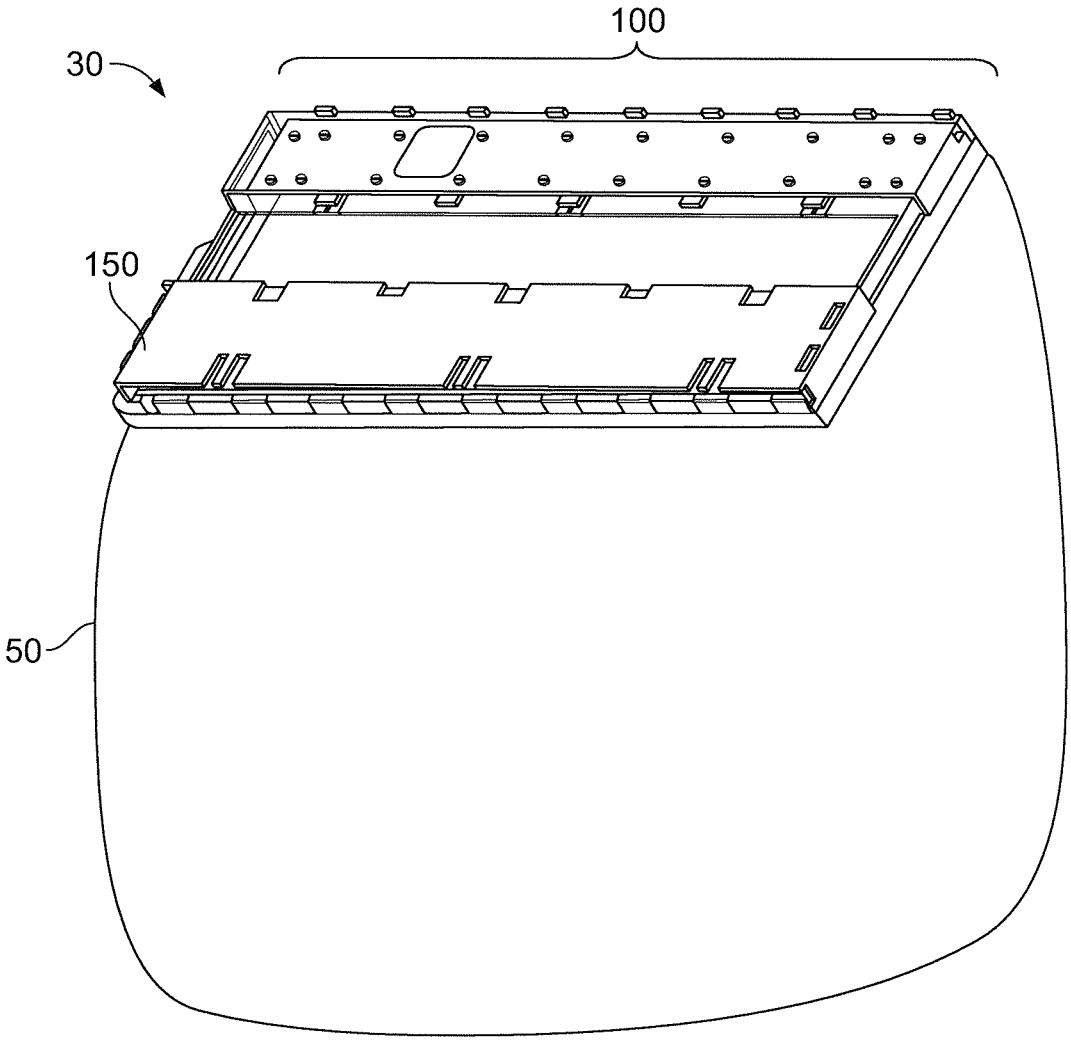
FIG. 3 illustrates an example container for storing items of value.

In an example embodiment, as illustrated in e.g., FIGS. 2 and 3, a container 30 can be removably coupled to cassette 10. A closure mechanism 100 can be coupled to container 30 and configured to be transitioned from an open position, as shown in FIG. 2, to a closed position. Also illustrated in the example embodiment of FIG. 2 is a locking mechanism 40 coupled to door 20. Locking mechanism 40 is configured to selectively lock door 20 to cassette 10 when door 20 is in a closed position as shown in FIG. 1.

In an example embodiment illustrated in FIG. 3, container 30 can include a housing 50 coupled to closure mechanism 100. In some implementations, closure mechanism 100 further includes an aperture plate 120, and a shutter 150. In some implementations, aperture plate 120 and housing 50 are two separate components fixedly coupled together and in other implementations, housing 50 and aperture plate 120 can be integrally formed together.

Figure 4:
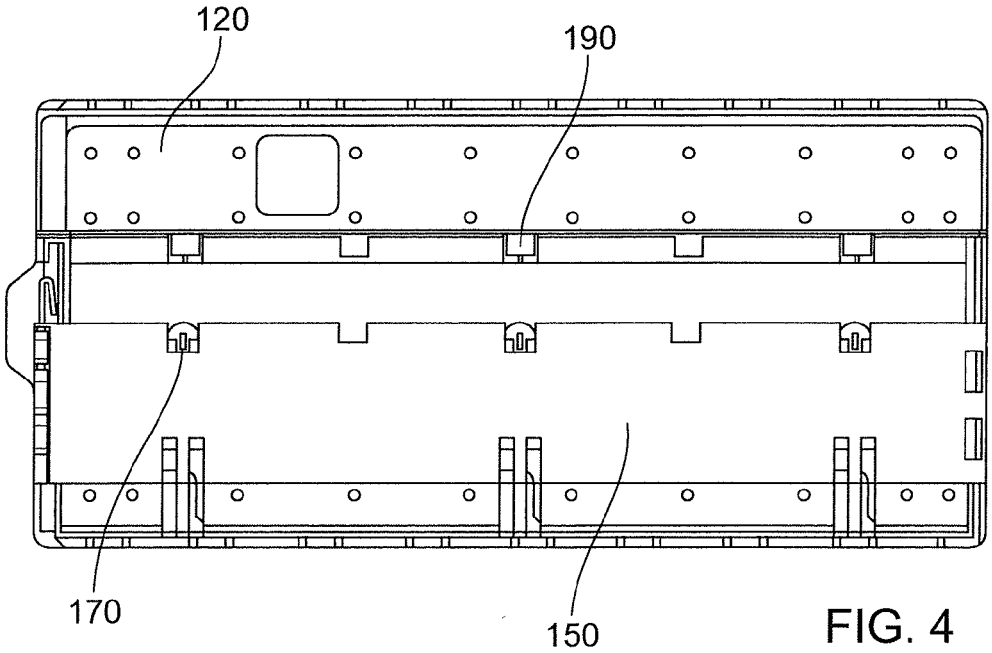
FIG. 4 illustrates an example closure mechanism for a container for storing items of value.

Aperture plate 120 can further include shutter 150 operatively coupled to aperture plate 120 for transition between an open position and a closed position. When shutter 150 is in an open position (shown in FIG. 3), items of value can be inserted into container 30. In some implementations, shutter 150 can be slidingly coupled to aperture plate 120. Shutter 150 can further include at least one locking feature 170 configured to secure shutter 150 to aperture plate 120 when shutter 150 is in a closed position (as shown in FIG. 4). In some implementations, shutter 150 includes a plurality of locking features 170 configured to secure shutter 150 to aperture plate 120 when shutter 150 is in a closed position.

In an example embodiment illustrated in FIG. 4, aperture plate 120 can be configured to include at least one locking receptacle 190 for locking engagement with the at least one locking feature 170 of shutter 150. In some implementations a plurality of locking receptacles 190 are configured on aperture plate 120 and capable of locking engagement with a complementary plurality of locking features 170 arranged on shutter 150.

Figure 5:
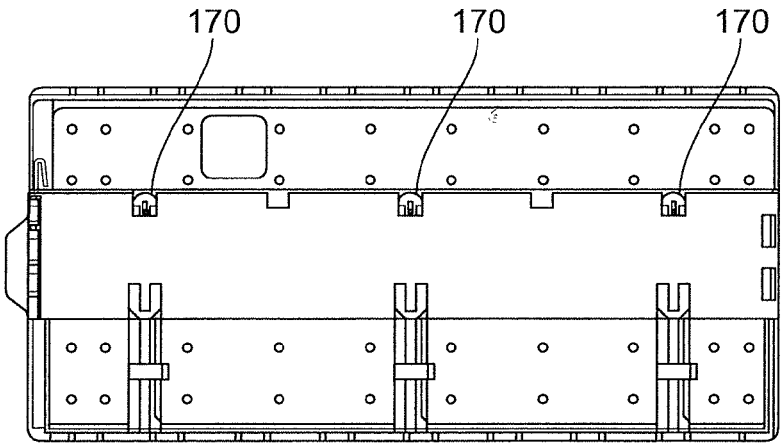
FIG. 5 illustrates an example closure mechanism and locking features of said closure mechanism.
Figure 5:
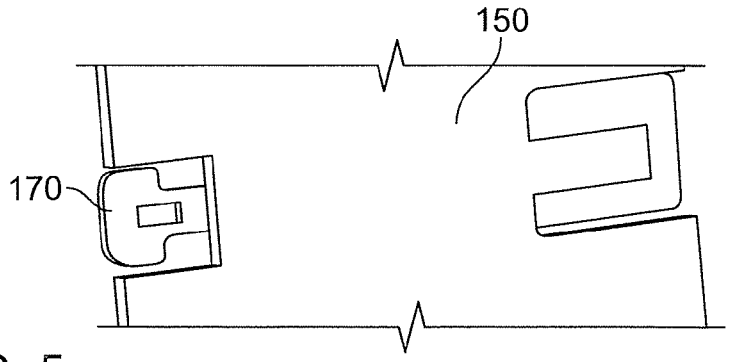

In a example implementation illustrated in FIG. 5, closure mechanism 100 includes shutter 150 configured with at least one frangible locking feature 170. As shown in the example embodiment of FIG. 5, locking features 170 are arranged to lockingly engage locking receptacles 190 of aperture plate 120 so as to secure shutter 150 to aperture plate 120 in a closed position. Once shutter 150 is locked in a closed position with aperture plate 120, any movement of shutter 150 from a closed position will result in permanent (e.g. visible) destruction or alteration of locking features 170 and therefore provide evidence that shutter 150 has been moved from the closed position.

Figure 6:
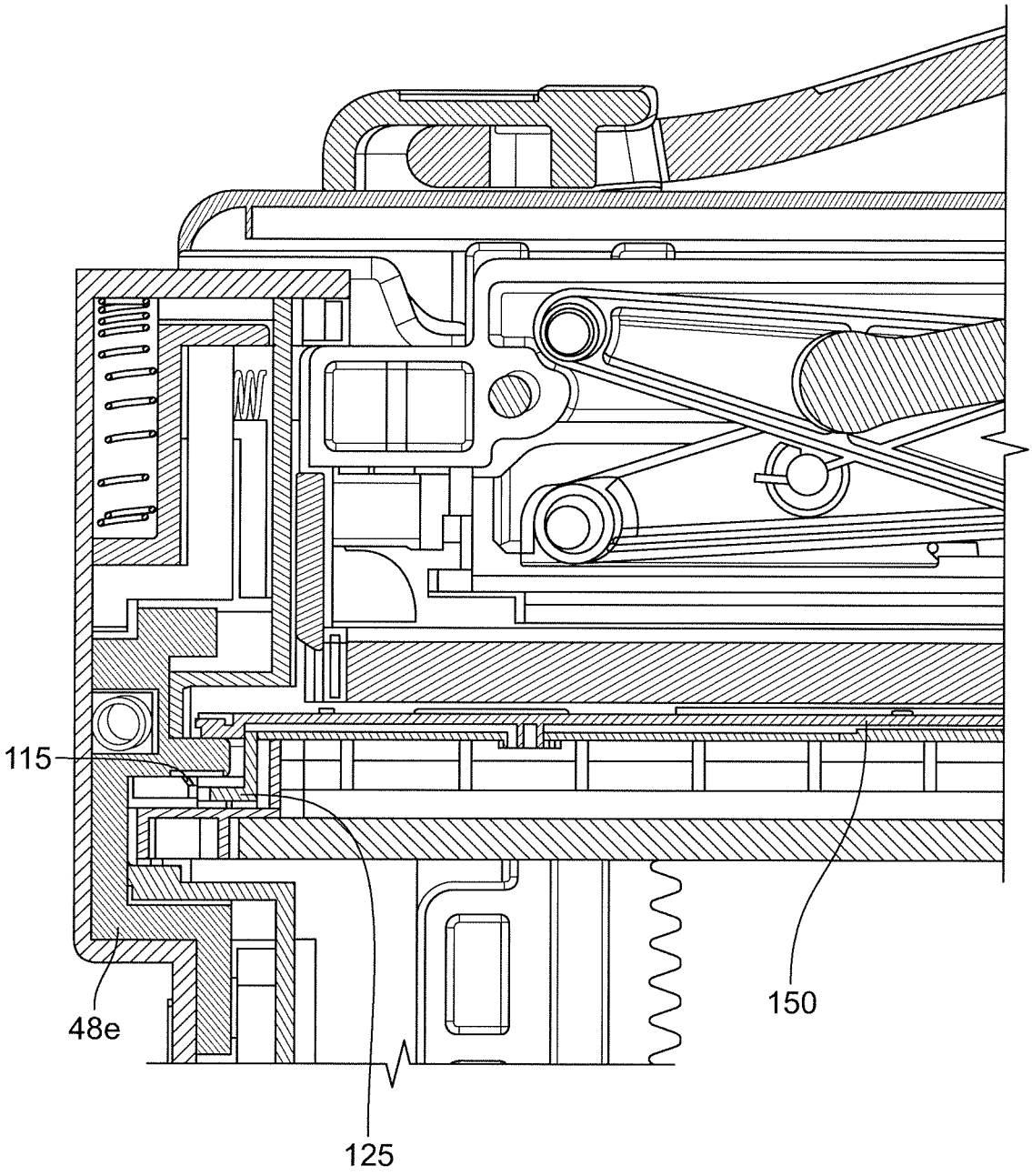
FIG. 6 illustrates an example closure mechanism.

In the example implementation, closure mechanism 100 can include aperture plate 120 arranged with rail features 125. Shutter 150 can include complementary shutter rails 115 for operative coupling with rail features 125 of aperture plate 120. In the example embodiment of FIG. 6, shutter 150 is configured for sliding engagement with aperture plate 120. In other implementations, shutter 150 can be coupled to aperture plate 120 using other techniques including, but not limited to pivoting, swinging, or snapping. In some implementations, the coupling of rail features 125 and shutter rails 115 result in an engagement allowing sliding motion of shutter 150 with respect to aperture plate 120. Sliding motion of shutter 150 relative to aperture plate 120 can occur along aperture plate 120 while preventing separation of shutter 150 from aperture plate 120. In some implementations, the complementary rail structures can be integrated with the channels used in conjunction with locking features 170.

Figure 7:
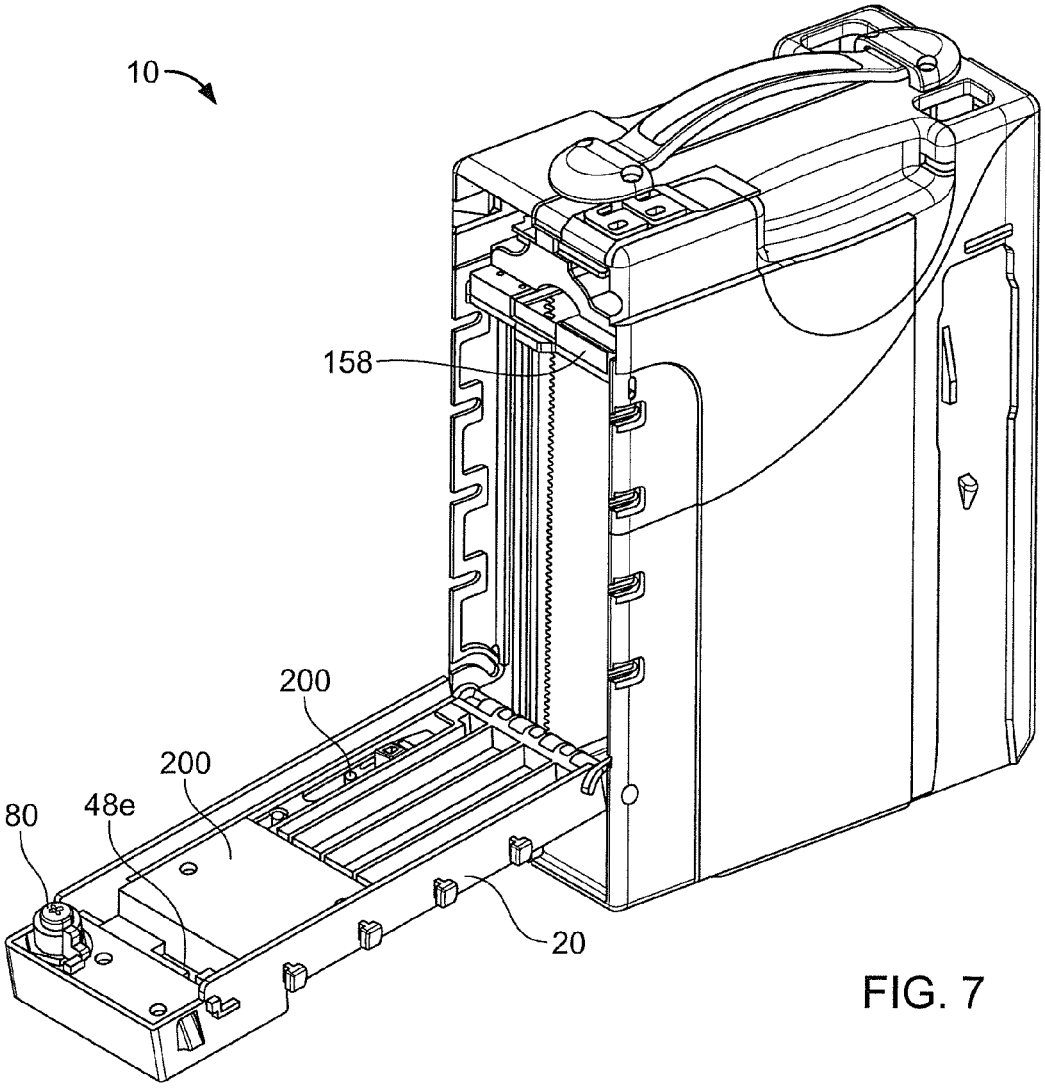
FIG. 7 illustrates an example apparatus for removably storing items of value including a locking mechanism.

In an example embodiment illustrated in FIG. 7, door 20 is shown in an open position. Locking mechanism 40, coupled to door 20, can further include a lock 80, and one or more actuation features 48*e*. Container 30 can be removably coupled to cassette 10, and further including closure mechanism 100, with shutter 150 operatively coupled to aperture plate 120. In some implementations, shutter 150 further includes at least one shutter actuation receptacle 158. Actuation feature 48*e* of locking mechanism 40 and shutter actuation receptacle 158 are configured to be selectively coupled together when door 20 is in a closed position. Locking mechanism 40 can be further configured to transition shutter 150 from an open position to a closed position.

Figure 8:
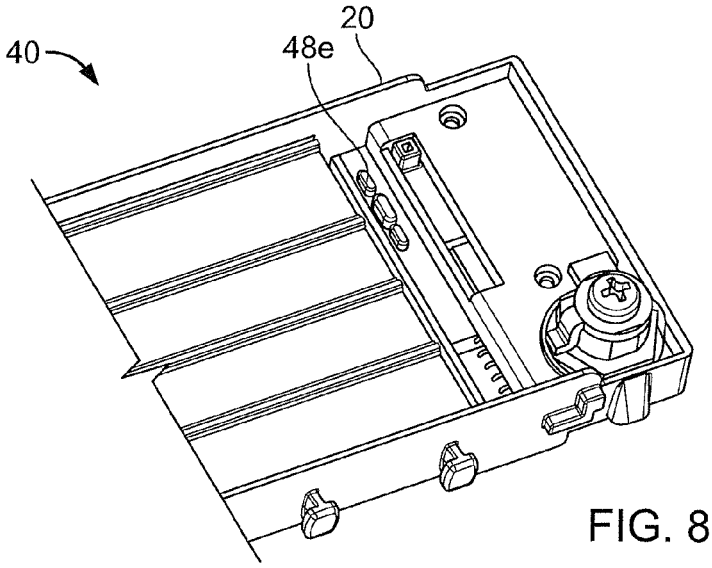
FIG. 8 illustrates an example locking mechanism capable of engagement with a closure mechanism.
Figure 9:
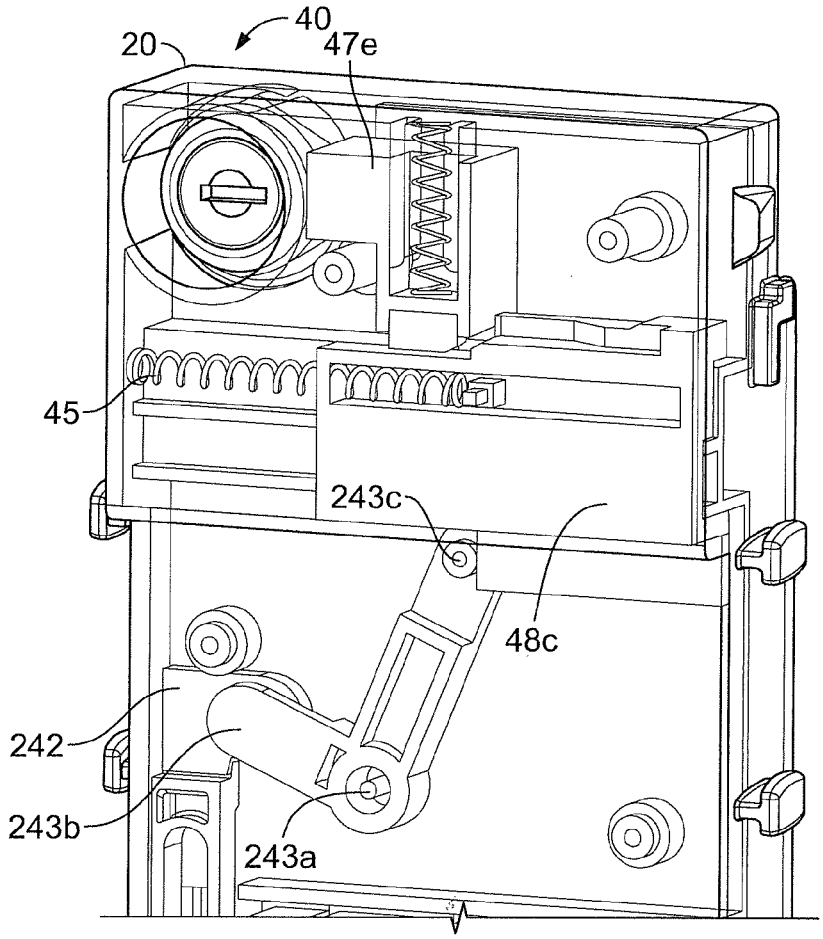
FIG. 9 an example locking mechanism operatively coupled to an example automatic reset mechanism.

In some implementations, locking mechanism 40 can further include lock 80, a shutter engagement plate 48*c*, and lock blocking member 47*e* as shown in FIG. 9. Shutter engagement plate 48*c* can be configured to include at least one shutter actuation feature 48*e* for mating engagement with at least one shutter actuation receptacle 158 as shown in FIG. 7 and FIG. 8.

Figure 10:
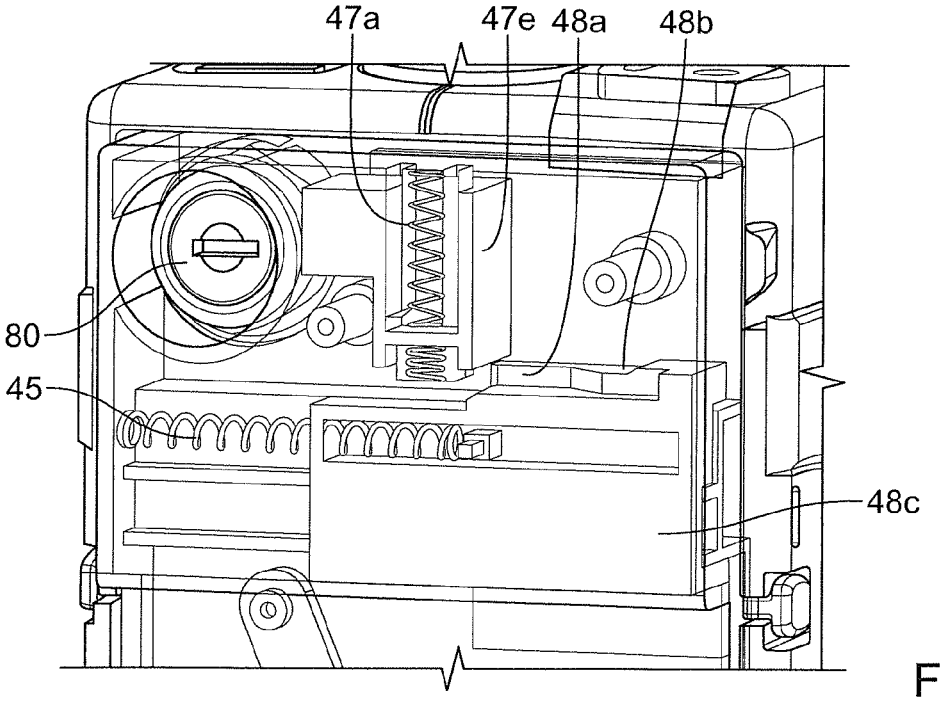
FIG. 10 illustrates a locking mechanism in an armed position.
Figure 11:
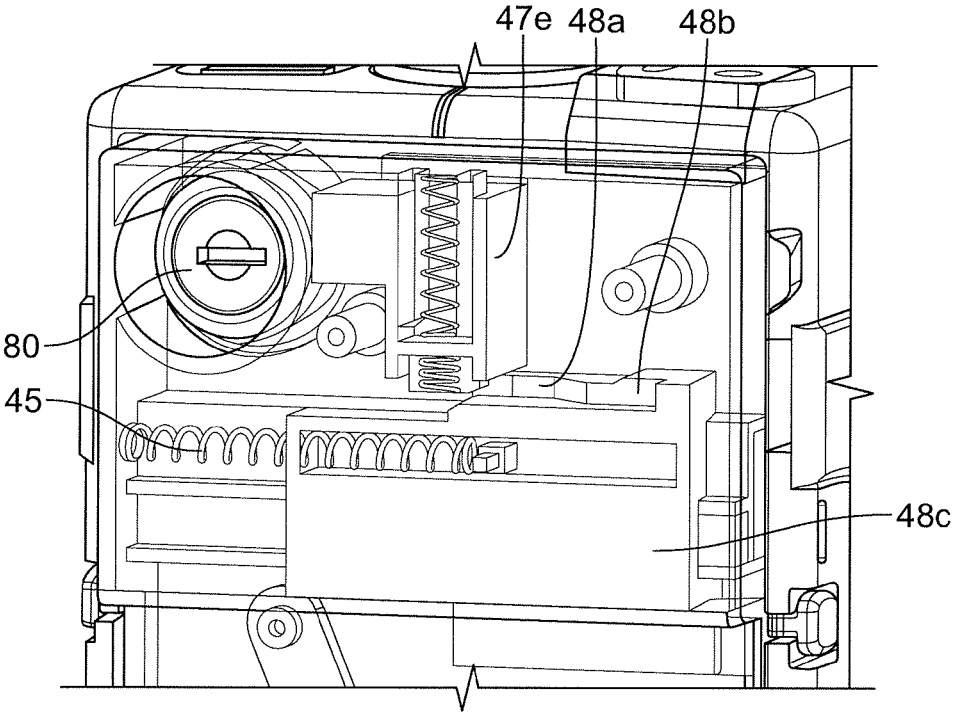
FIG. 11 illustrates a locking mechanism in transition between an armed position and an actuated position.
Figure 12:
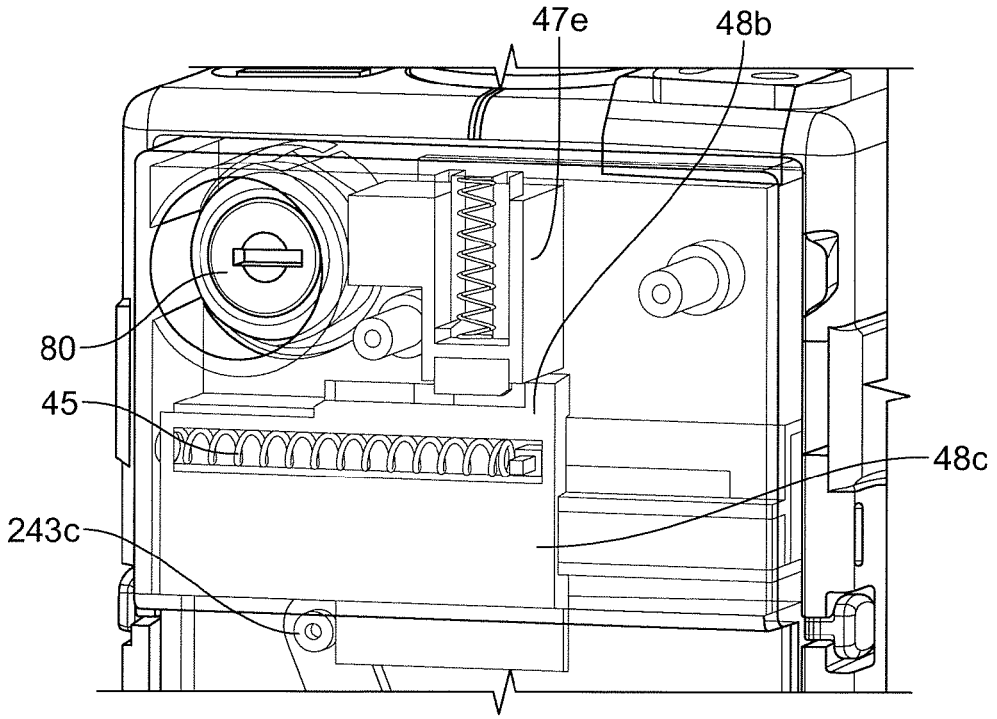
FIG. 12 illustrates a locking mechanism in an actuated position.
Figure 13:
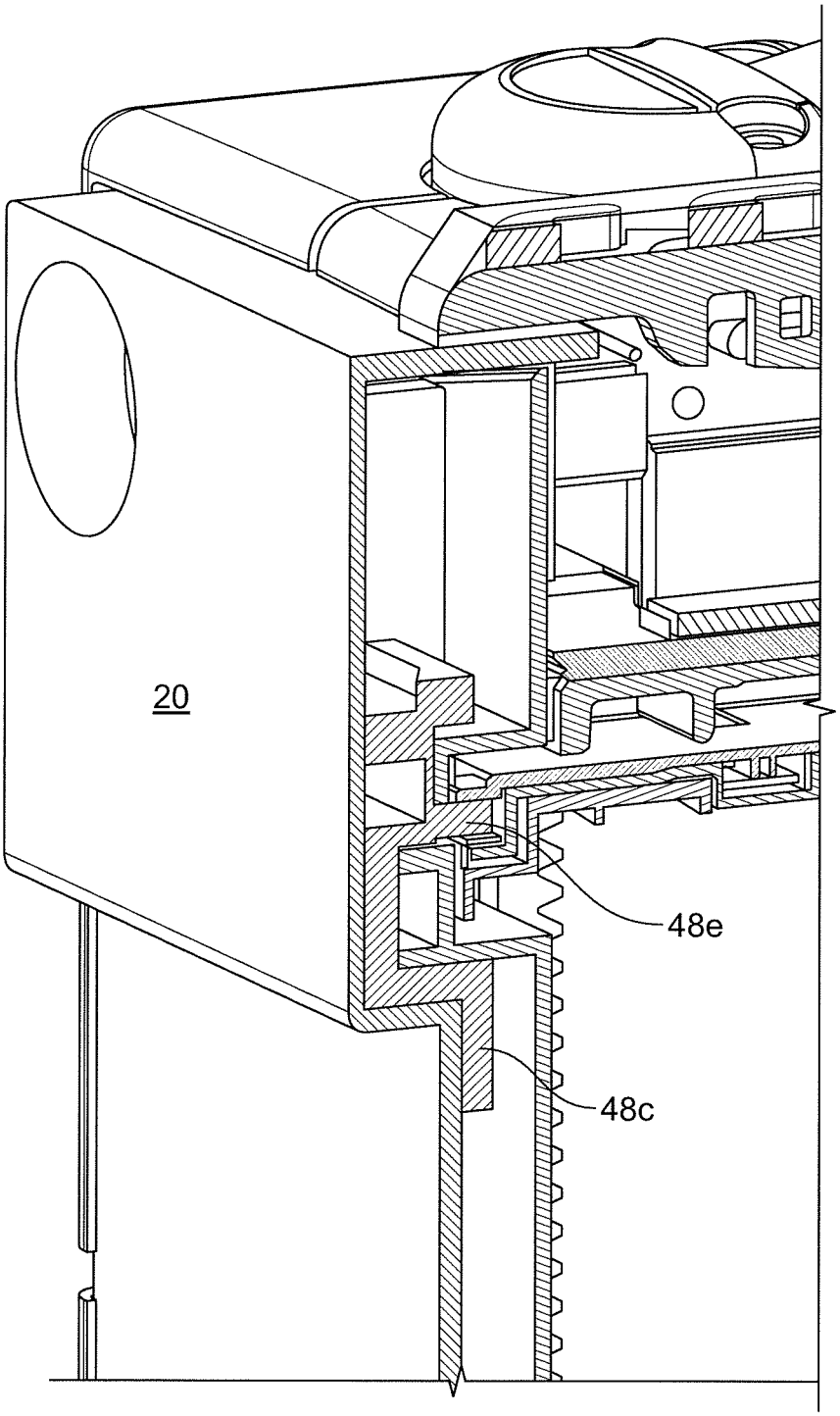
FIG. 13 illustrates the coupling of an example locking mechanism and an example closure mechanism.

In an example embodiment as illustrated in FIG. 8, locking mechanism 40 is shown in an armed position. As shown in an example embodiment illustrated in FIG. 9, locking mechanism 40 can further include a shutter engagement plate 48*c* selectively engagable with a lock blocking member 47*e*. Lock blocking member 47*e* is also configured for selective engagement with lock 80. Shutter engagement plate 48*c* is biased towards an actuated position by a plate biasing member 45 as shown in FIGS. 10, 11, and 12. Lock blocking member 47*e*, when in abutment with shutter engagement plate 48*c* prevents shutter engagement plate 48*c* from transitioning from the armed position (shown in FIG. 10) to an actuated position shown in FIG. 12.

In the example implementation illustrated in FIG. 7, locking mechanism 40, coupled to door 20, can further be arranged to include a locking mechanism automatic reset mechanism 200. In some implementations, automatic reset mechanism 200 is configured to transition locking mechanism 40 from an actuated state to an armed state as door 20 transitions from a closed position to an open position.

In some implementations, locking mechanism reset mechanism 200 can further include a pivot arm 243 configured to drive shutter engagement plate 48*c* from the actuated position to the armed position as door 20 transitions from a closed position to an open position. Reset mechanism 200 can further include a pushrod 242 and a pivot lever 250. Pivot lever 250 is operatively coupled to cassette 10 so that as door 20 rotates from the closed position to the open position, pivot lever 250 induces a longitudinal force on pushrod 242. Continued movement of door 20 toward the open position results in longitudinal displacement of pushrod 242 along the length of door 20. Longitudinal displacement of pushrod 242 in relation to door 20 causes rotational movement of pivot arm 243.

The operation of the example mechanisms and system disclosed herein will now be described.

Figure 15:
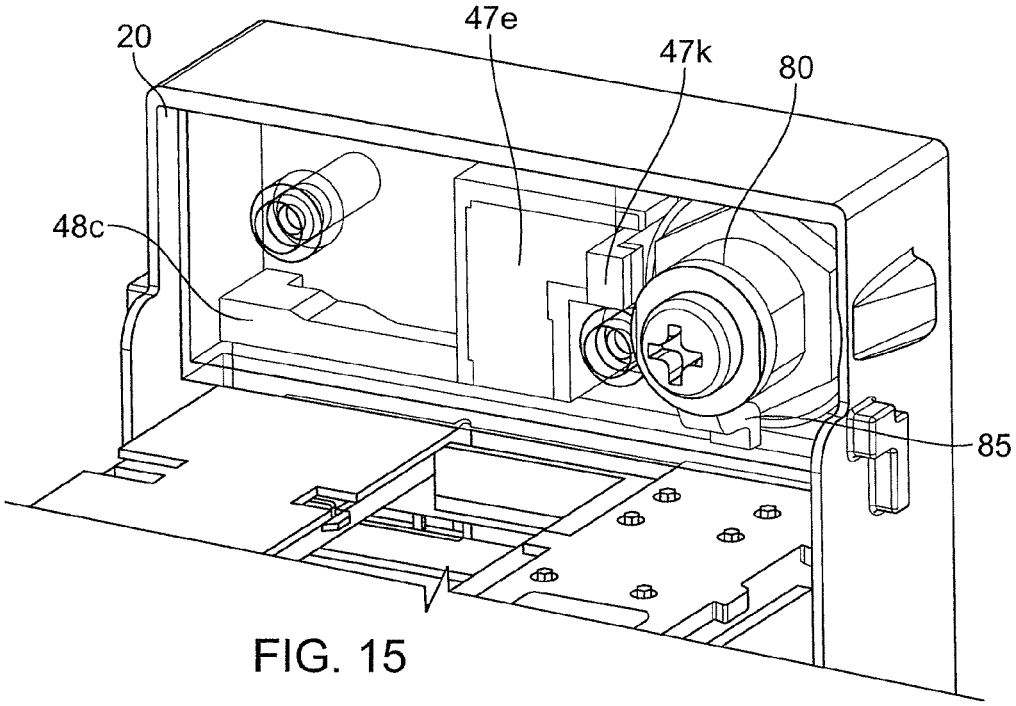
FIG. 15 illustrates an example lock and locking mechanism.
Figure 16:
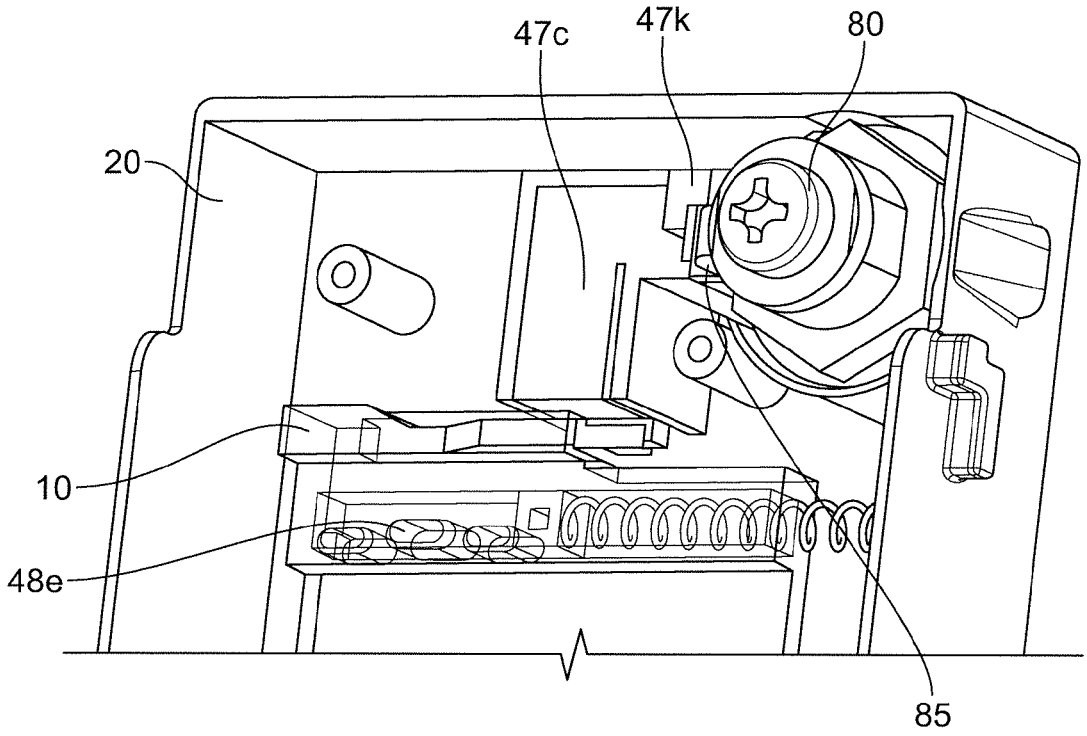
FIG. 16 illustrates an example transition of a blocking member from a blocking state to an unblocked state.
Figure 17:
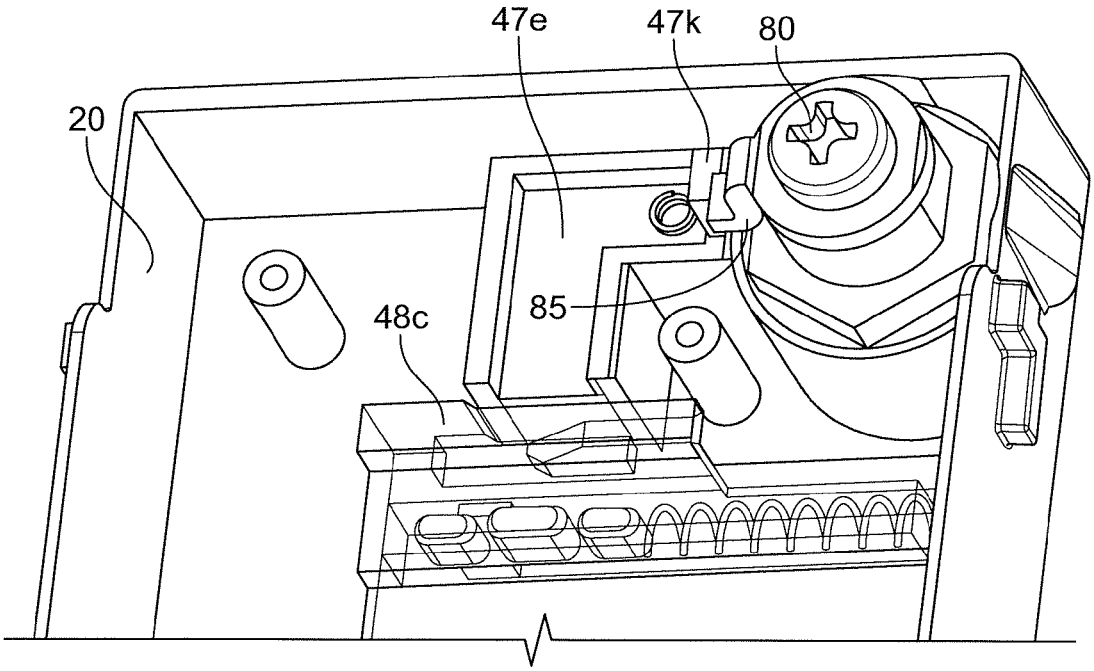
FIG. 17 illustrates a blocking member in an unblocked state.

Starting with a cassette 10 in a closed and locked position, a user, operator, or service person desire to gain access to container 30 for retrieval or transport from a host machine to a remote location for sorting, storage or counting. Such locations can include, but not limited to banks, central facilities, home office, federal banks, or any other facility or location where containers 30 are delivered for further processing. When access to container 30 is required a lock 80 must be transitioned from a locked condition whereby door 20 is in a closed position and secured to cassette 10. As lock 80 is actuated from a locked position to an unlocked position, locking mechanism 40 is transitioned from an armed position to an actuated position. For examples, as lock 80 is transitioned from a locked condition, lock tab 85 engages blocking member 47*e* (e.g. at blocking tab 47*k*) and moves blocking member 47*e* out of abutment with shutter engagement plate 48*c* (shown in FIGS. 10, 15, and 16). Transition of blocking member 47*e* out of abutment with shutter engagement plate 48*c* is in a direction opposite a biasing force exerted on blocking member 47*e* by blocking member bias 47*a* (shown in FIG. 10).

Figure 18:
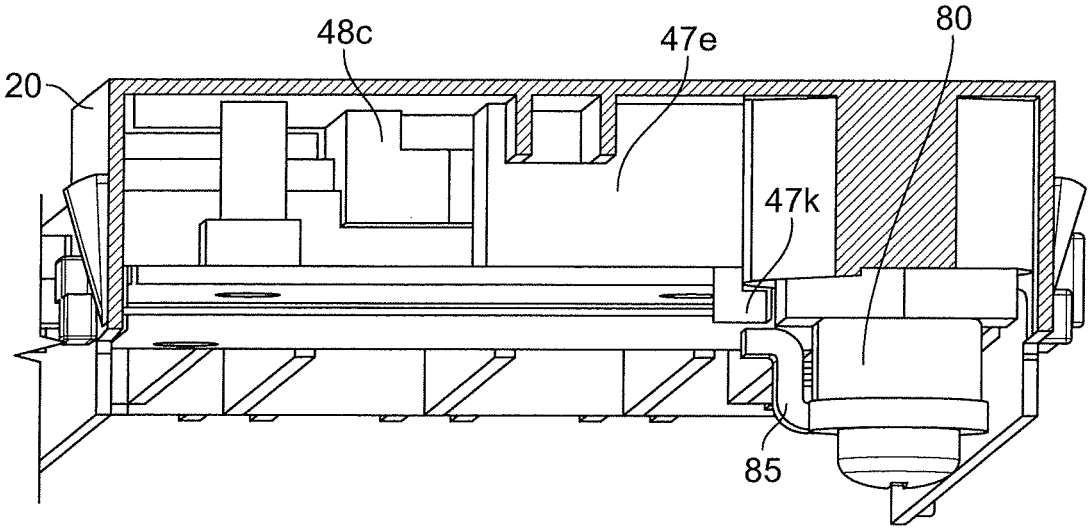
FIG. 18 illustrates the position of the blocking member relative to the lock when the locking mechanism is in an actuated state.

Once blocking member 47*e* is no longer in abutment with shutter engagement plate 48*c*, plate biasing member 45 (e.g. a spring), exerts a biasing force on shutter engagement plate 48*c* towards the actuated position. As shutter engagement plate 48*c* transitions from the armed position (shown in FIGS. 15, and 11), blocking member 47*e* is in operative engagement with a first drive surface 48*a* of shutter engagement plate 48*c*. Continued movement of shutter engagement plate 48*c* towards the actuated position shown in FIG. 12, blocking member 47*e* further engages a second drive surface 48*b* of shutter engagement plate 48*c*. As blocking member 47*e* engages second drive surface 48*b*, blocking tab 47*k* is displaced laterally from lock tab 85 (shown in FIG. 18). Such a position allows lock 80 to be actuated without engagement or manipulation of locking mechanism 40. Continued movement of shutter engagement plate 48*c* concludes in the actuated position (shown in FIG. 12).

Concurrently as exemplified above, locking mechanism 40 transitions shutter 150 from an open position to a closed position. For example, as shutter engagement plate 48*c* is released from blocking member 47*e*, actuation feature 48*e*, being in mating engagement with locking receptacle 158, causes shutter 150 to transition from an open position to a locked position in locking engagement with aperture plate 120. As shutter 150 transitions to a closed position, locking features 170 (e.g. locking tabs 170*a*) lockingly engage aperture plate locking receptacle 190. In the preceding example, only a single locking feature and locking tab have been described; however, shutter 150 and aperture plate 120 may have a plurality of locking features and receptacles respectively without deviating from or limiting the scope of the present disclosure.

Figure 23:
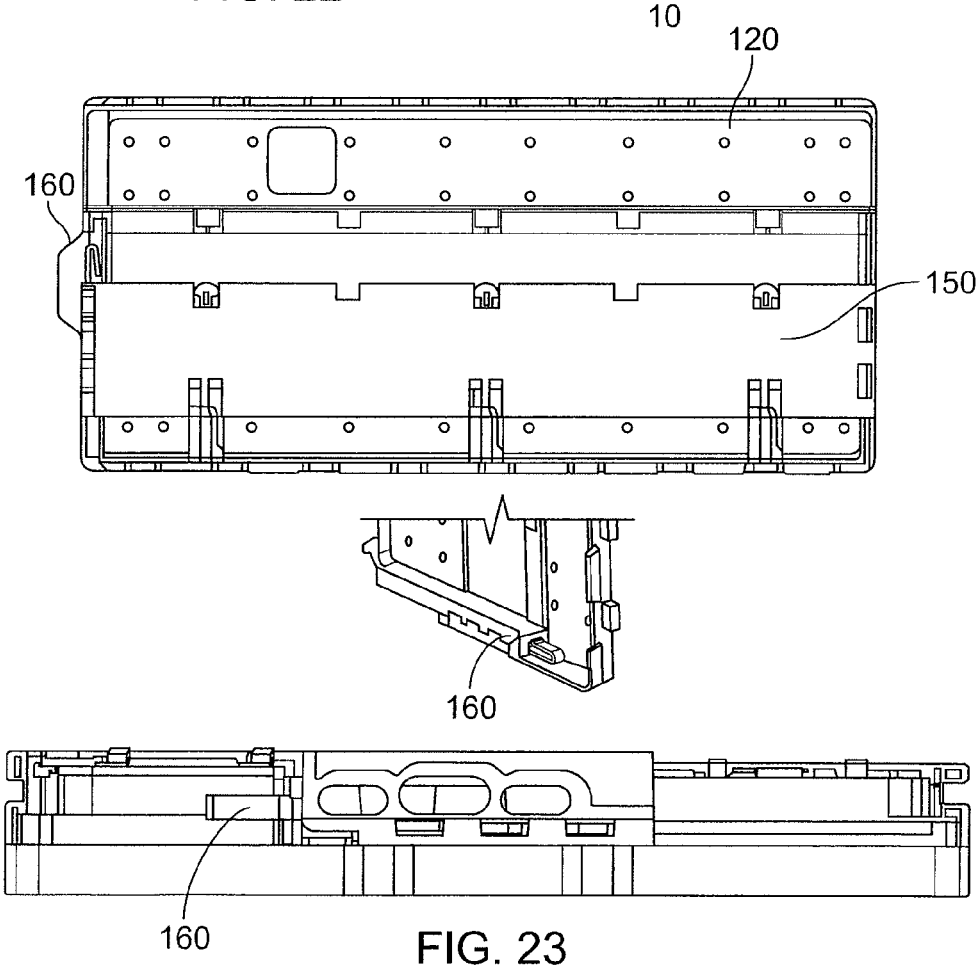
FIG. 23 illustrates tamper evident features of the closure mechanism.

As shutter 150 lockingly engages with aperture plate 120, container 30 is now in a secure and closed state in which items located within container 30 can no longer be accessed. Any attempt to access the contents of container 30 will result in a permanent and identifiable change (e.g., frangible locking features) in the closure mechanism 100. In some embodiments, shutter 150 additionally includes tamper evident feature 160 located along the sides of interface of aperture plate 120 and shutter 150. Tamper evident features 160 can be configured to prevent reversal of the position of shutter 150 from the closed position such as the example shown in FIG. 23.

Once locking mechanism 40 has been transitioned from the armed position to the actuated position (thus activating closure mechanism 100) and securing the contents to container 30, door 20 of cassette 10 can be opened. Once lock 80 is in the unlocked position, door 20 can be transitioned from a closed position to an open position (e.g. by rotation as shown in the figures). As door 20 is withdrawn from the closed position actuation features 48*e* is moved out of engagement with shutter locking receptacles 158. The disengagement of actuation features 48*e* and shutter receptacles 158 allows for free movement of shutter engagement plate 48*c*.

Figure 19:
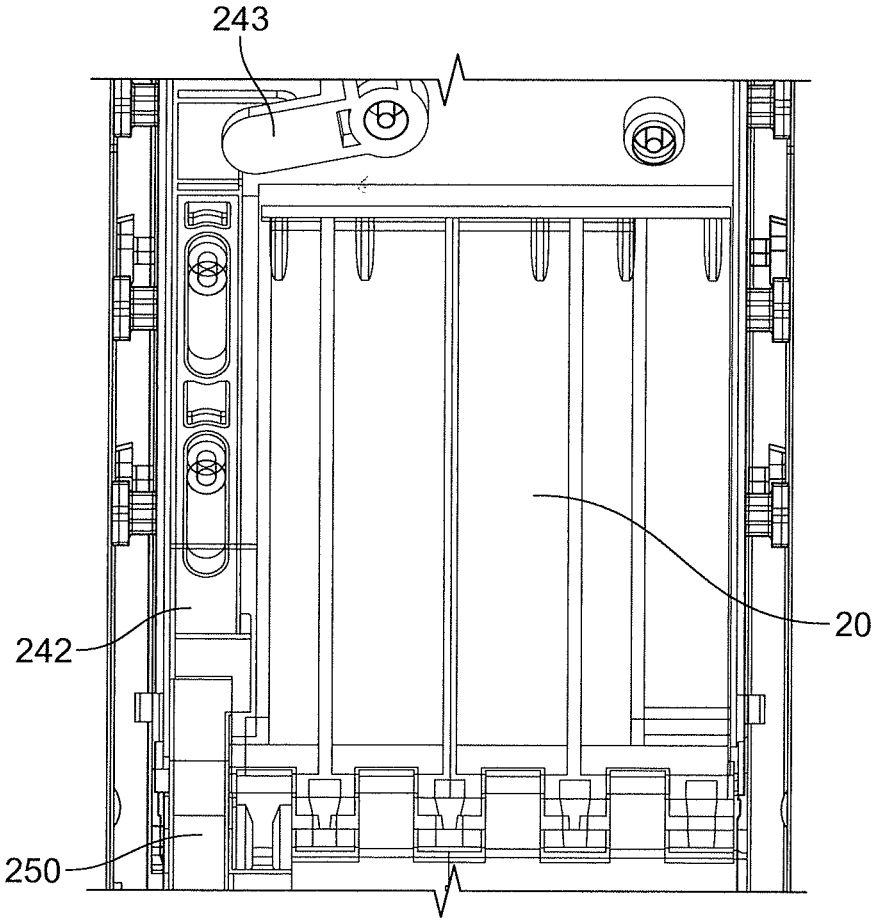
FIG. 19 illustrates an example linkage mechanism of an auto reset mechanism operatively coupled to a locking mechanism.
Figure 21:
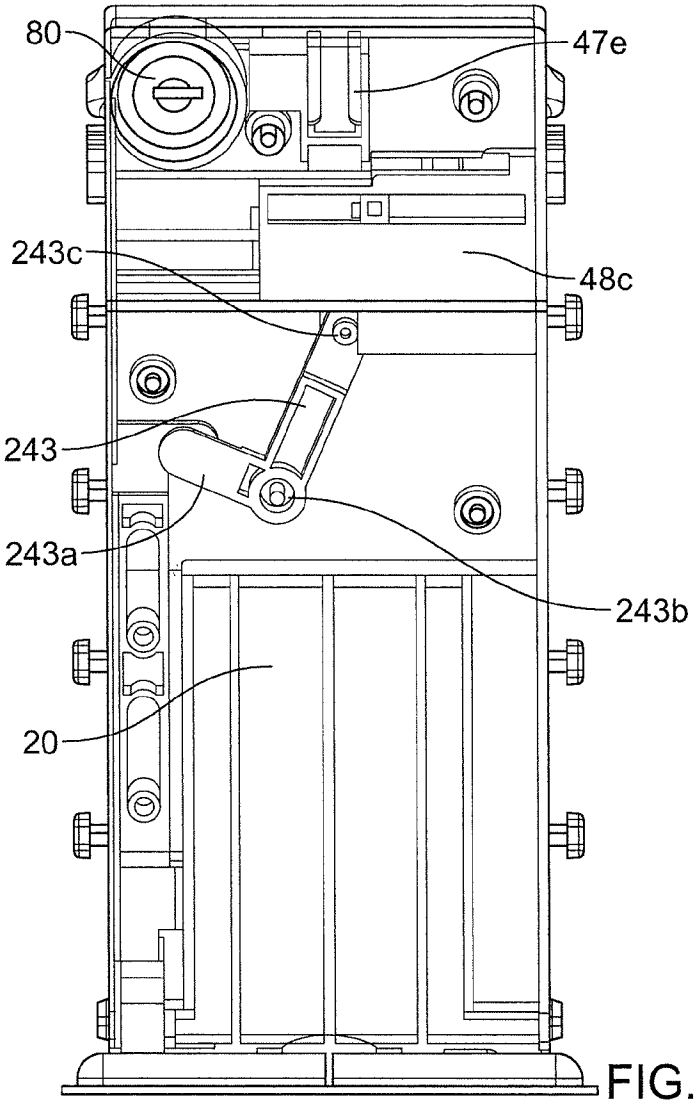
FIG. 21 illustrates the automatic reset mechanism engaged with the locking mechanism in the armed position.
Figure 20:
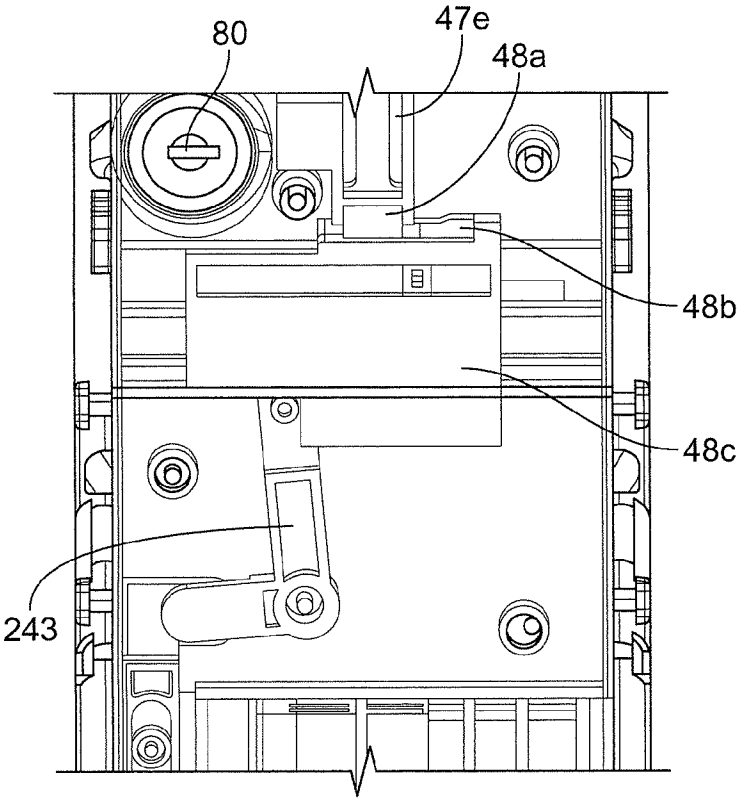
FIG. 20 illustrates the locking mechanism in an intermediate position between an armed position and an actuated position.
Figure 22:
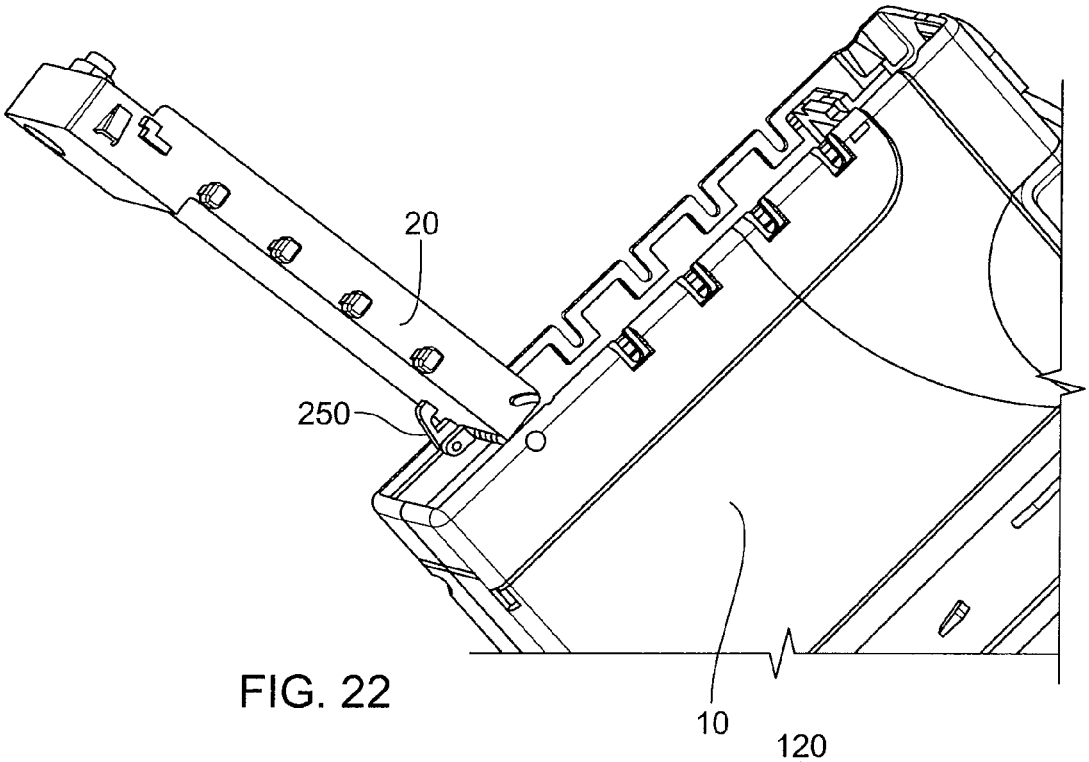
FIG. 22 illustrates the door of the cassette in the open position.

As door 20 continues to move to the full open position, automatic reset mechanism 200 transitions locking mechanism 40 from the actuated position to the armed position. In an example embodiment, as door 20 rotates from the closed position, pivot lever 250 engages cassette 10. Continued movement of door 20 causes a longitudinal force to be exerted from pivot lever 250 to pushrod 242. This causes push rod 242 to be longitudinally displaced away from the pivot between door 20 and cassette 10. Displacement of pushrod 242 causes pivot arm 243 to rotate in a clockwise direction. Pivot arm 243 is pivotally coupled to pushrod 242 at pivot 243*a*. Pivot arm 243 is pivotally coupled to door 20 at pivot 243*b* to form a pivot axis for pivot arm 243. Continued clockwise rotation of pivot arm 243, having abutment surface 243*c* and in abutting engagement with shutter engagement plate 48*c*, forces lateral movement of shutter engagement plate 48*c* from an actuated position to an armed position (shown in FIGS. 19-21).

As pivot arm 243 rotates in a clockwise direction, shutter engagement plate 48*c* transitions to an armed position. As shutter engagement plate 48*c* moves laterally, blocking member 47*e* transitions back to a blocking position in abutment with shutter engagement plate 48*c* (and thus preventing shutter engagement plate 48*c* from moving to the actuated position). Blocking tab 47*k* is prevented from returning to a home position. This allows lock 80 to be transitioned from an unlock position to a locked position without triggering locking mechanism 40 (shown in FIG. 19).

As door 20 returns to a closed position, locking mechanism 40, and thus shutter engagement plate 48*c*, is returned to an armed position and capable of engaging closure mechanism 100, and thus shutter 150. In the closed position of door 20, actuation features 48*e* are brought into engagement with shutter locking receptacles 158 of an unactuated (e.g. open, new, replacement, etc.) container 30.

Figure 14:
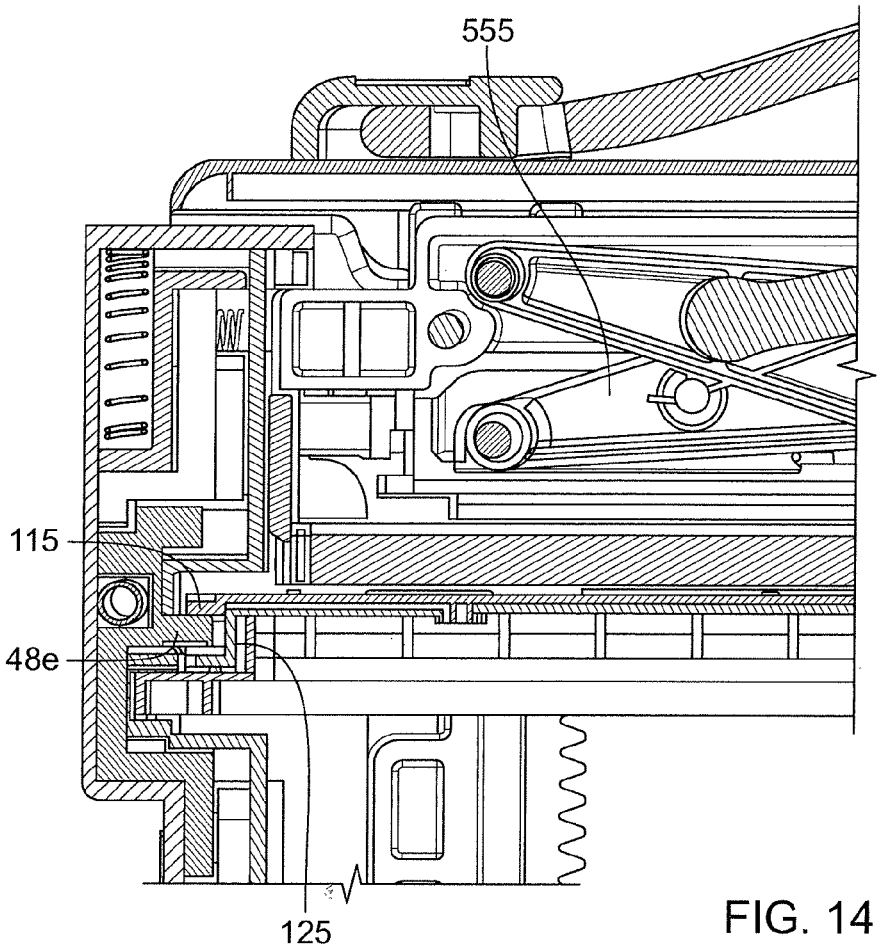
FIG. 14 illustrates the coupling of an example locking mechanism and a container for storing items of value.
Figure 24:
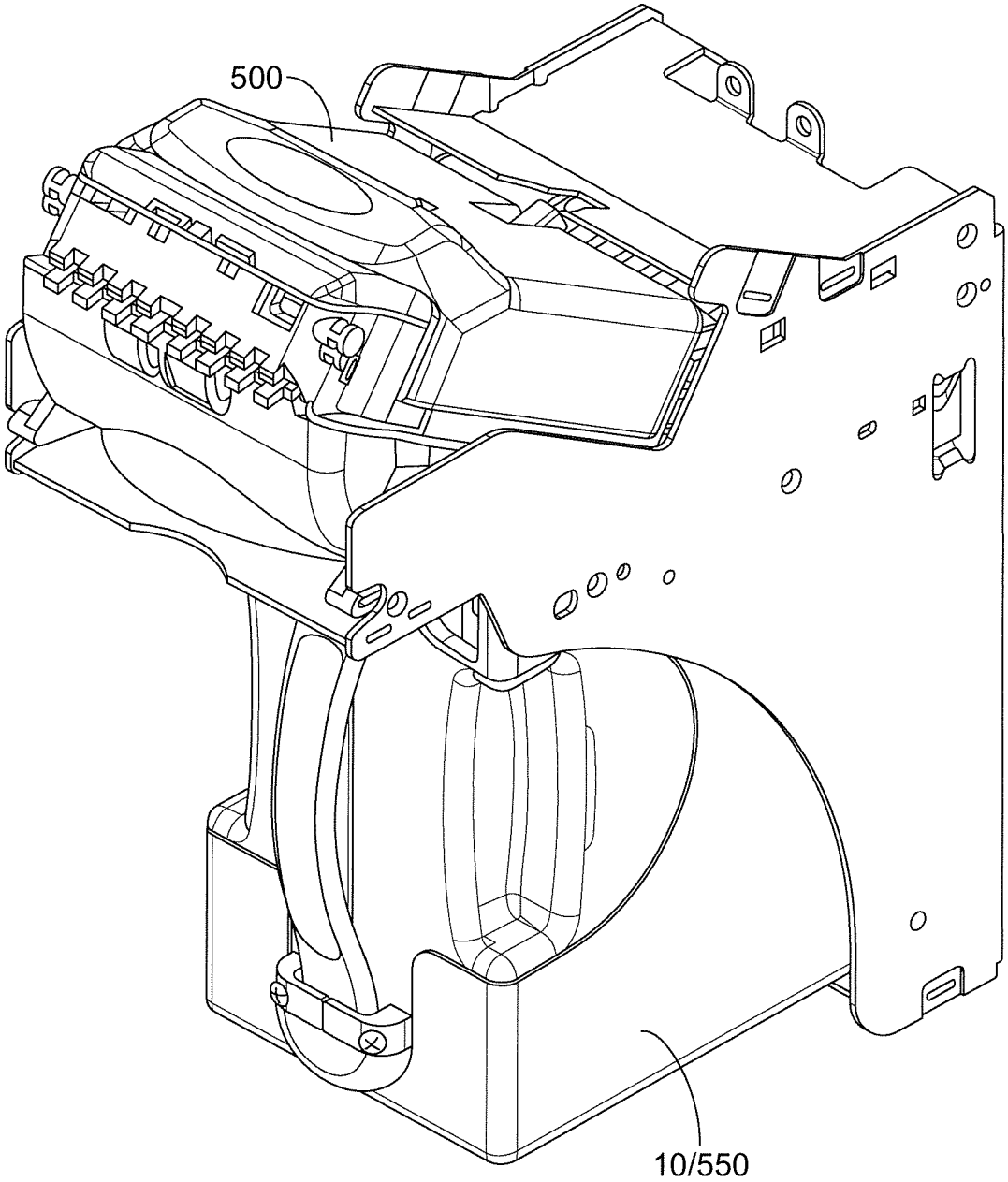
FIG. 24 illustrates a storage apparatus removably coupled to a currency validator.

FIG. 24 illustrates an example implementation of apparatus for storing items of value 10 is removably coupled to a currency validator 500 such as the system described in U.S. patent application with the publication number US 20040213620 A1 (assigned to the applicant) which is expressly incorporated herein by reference in its entirety. Currency validator 500 can further include a currency cassette 550. In some implementations currency cassette 550 can include a sheet stacking mechanism 555 (shown in FIG. 14) contained therein. In other implementations (not shown), currency validator 500 includes a sheet stacking mechanism 555 operatively coupled to currency validator 500 and in turn coupled to an apparatus for storing items of value 10. While the present disclosure exemplifies implementations having storage apparatus 10 removably coupled to sheet stacking mechanism 555, the location of sheet stacking mechanism 555, for example within a currency cassette 550, does not in any way limit the scope of the current disclosure. Implementations in which storage apparatus 10 are coupled to a sheet stacking mechanism 555 not located within a currency cassette 550 are within the current scope of the disclosure.

Although a few variations have been described in detail above, other modifications are possible. For example, the implementations described above can be directed to various combinations and subcombinations of the disclosed features and/or combinations and subcombinations of several further features disclosed above. In addition, the logic flows described herein do not require the particular order shown, or sequential order, to achieve desirable results. Other embodiments may be within the scope of the following claims.

What is claimed is:

1. A system to store one or more items of value, the system comprising:

a lockable cassette that includes an inner cavity and an opening to receive the one or more items of value;

a door coupled to the cassette and configured to transition between an open position that provides access to the inner cavity and a closed position that prevents access to the inner cavity;

a container removably coupled to the cassette and configured to:

securely store the one or more items of value, and restrict access to the one or more stored items of value using a closure mechanism; and a locking mechanism coupled to the door and configured to:

selectively lock the door in the closed position, and actuate the closure mechanism via an engagement with the locking mechanism.

2. The system of claim 1, wherein the closure mechanism further comprises an aperture plate and shutter movably coupled to the aperture plate.

3. The system of claim 2, wherein the shutter is configured to selectively transition between an open position permitting the container to receive the one or more items of value and a closed position preventing the one or more items of value from being inserted or removed from the container.

4. The system of claim 2, wherein the shutter further comprises at least one locking device configured to lock the aperture plate when the shutter is in a closed position.

5. The system of claim 4, wherein the at least one locking device of the shutter is frangible.

6. The system of claim 4, wherein the at least one locking device comprises at least one locking tab each configured to lock with the aperture plate by inserting the at least one locking device into a locking receptacle located in the aperture plate.

7. The system of claim 1, wherein the locking mechanism is configured to engage with the closure mechanism when the door is in the closed position.

8. The system of claim 1, wherein the locking mechanism is configured to transition the closure mechanism from an open position to a closed position when the locking mechanism is transitioned from an aimed state to an actuated state.

9. The system of claim 1, wherein the locking mechanism comprises a lock configured to selectively lock the door to the cassette and actuate the locking mechanism.

10. The system of claim 1, wherein the locking mechanism comprises a shutter engagement plate configured to engage with a shutter of the closure mechanism when the door is in the closed position.

11. The system of claim 10, wherein the shutter includes at least one locking mechanism engagement receptacle configured to receive at least one actuation device of the shutter engagement plate.

12. The system of claim 11, wherein the locking mechanism further comprises a shutter engagement plate biasing mechanism.

13. The system of claim 12, wherein the locking mechanism further comprises a shutter plate blocking component configured to be selectively displaced by a lock.

14. The system of claim 13, wherein the locking mechanism further comprises an automatic reset mechanism and linkage system configured to actuate a shutter locking plate from an activated position to an armed position as the door is transitioned from the open position to the closed position.

15. The system of claim 14, wherein the linkage system comprises:

a pivot arm;

a pushrod; and a pivot lever configured to provide a longitudinal force on the pushrod to longitudinally displace the pushrod relative to the door when the door is transitioned between the closed position and the open position, wherein the longitudinal displacement of the pushrod causes rotational movement of the pivot arm, and wherein the rotation of the pivot arm during a transition of the door from the closed position to the open position causes the pivot arm to transition the locking mechanism from an actuated state to an armed state.

16. The system of claim 1, wherein the locking mechanism is configured to actuate the closure mechanism when the container is coupled to the cassette.

17. The system of claim 1, wherein the locking mechanism is configured to actuate the closure mechanism when the container is coupled to the cassette and the door transitions between the open position and the closed position.

18. An apparatus to secure one or more items of value, the apparatus comprising:

a housing configured to receive the one or more items of value via an opening through an aperture plate; and a closure mechanism including a shutter operably coupled to the aperture plate and configured to transition, via an engagement with a locking mechanism for a door of a container that receives the housing, between an open position permitting the reception of the one or more items of value by the housing via the opening and a closed position preventing the reception of the one or more items of value by the housing via the opening.

19. The apparatus of claim 18, wherein the shutter further includes at least one frangible locking device configured to lock the aperture plate when the shudder is in the closed position.

20. The apparatus of claim 19, wherein the at least one locking device comprises at least one locking tab each configured to lock with the aperture plate by inserting the at least one locking tab into a locking receptacle located in the aperture plate.

* * * * *